US005725331A

United States Patent [19]

Martinez

[11] Patent Number: 5,725,331

[45] Date of Patent: Mar. 10, 1998

[54] PROCESS FOR INSTALLATING A TIGHT CROSSING IN THE WALL OF A CELL

[75] Inventor: Jacques Martinez, Loriol-du-Comtat, France

[73] Assignee: Commissariat a l'Energie Atomique, Paris, France

[21] Appl. No.: 644,032

[22] Filed: May 9, 1996

[30] Foreign Application Priority Data

May 12, 1995 [FR] France ..... 95 05653

[51] Int. Cl.[6] ..... G21C 13/02

[52] U.S. Cl. ..... 405/303; 52/220.8; 250/517.1; 285/208; 376/203; 376/292; 405/52; 405/53

[58] Field of Search ..... 405/132, 150.1, 405/151, 52–59, 303; 52/220.8; 250/517.1; 376/287, 289, 291, 292, 203, 204; 285/192, 208; 976/DIG. 169, DIG. 180, DIG. 210, DIG. 235

[56] References Cited

U.S. PATENT DOCUMENTS

| | | | |
|---|---|---|---|
| 1,734,966 | 11/1929 | Elmendorf | 285/206 X |
| 2,243,356 | 5/1941 | Olson | 285/206 X |
| 2,348,490 | 5/1944 | Newman et al. | 235/206 X |
| 2,580,802 | 1/1952 | Lindberg | 285/206 |
| 2,711,841 | 6/1955 | Schaefer et al. | 285/192 X |
| 2,945,705 | 7/1960 | Murray | 52/220.8 X |
| 3,125,358 | 3/1964 | Kleinberg et al. | 285/192 X |
| 3,352,756 | 11/1967 | Lockett et al. | 376/287 X |
| 3,488,067 | 1/1970 | Sommer | 376/291 X |
| 3,707,758 | 1/1973 | Townsend | 376/203 X |
| 4,028,176 | 6/1977 | Kraupa | 376/287 X |
| 4,194,948 | 3/1980 | Ledin | 376/203 X |
| 4,223,740 | 9/1980 | Clayton | 52/220.8 X |
| 4,587,082 | 5/1986 | Schoening et al. . | |
| 5,456,050 | 10/1995 | Ward | 52/220.8 |

FOREIGN PATENT DOCUMENTS

| | | |
|---|---|---|
| 144683 | 10/1980 | Germany . |
| 3030030 | 3/1982 | Germany . |
| 3042613 | 6/1982 | Germany . |
| 8709361 | 9/1987 | Germany . |
| 3843311 | 6/1990 | Germany . |

*Primary Examiner*—Dennis L. Taylor

*Attorney, Agent, or Firm*—Pearne, Gordon, McCoy & Granger LLP

[57] ABSTRACT

A tight crossing to ensure a high efficiency seal between the interior (1) and the exterior (2) of a high activity cell. The crossing comprises a sleeve (6) placed in the wall (3), a guide tube (11) placed within the sleeve (6) and a support flange (12) placed between the sleeve (6) and the guide tube (11) on its outer end. A joint holder flange or ring (15) is placed in the cell interior (1) and is secured against the cell skin (4), the guide tube (11) and the sleeve (6) by means of captive bolts (18).

7 Claims, 2 Drawing Sheets

PROCESS FOR INSTALLATING A TIGHT CROSSING IN THE WALL OF A CELL

FIELD OF THE INVENTION

The invention relates to the installation of equipments in the wall of a tight cell used for operations in a high activity atmosphere, e.g. for the transfer of irradiated waste or small tools through the wall and in particular the installation of a tight passage. This installation must be performable after the putting into service of the cell, i.e. when the interior of the latter is already contaminated.

PRIOR ART AND SET PROBLEM

Within the framework of using so-called high activity cells, it arises that it is necessary to provide the installation in one or more passages of the cell wall of certain types of equipments such as remote manipulators, cameras, periscopes or mechanical passages. The latter must also make it possible to discharge irradiated waste or small tools from the cell or the introduction of the samples to be treated into the interior thereof. These operations are performed by means of special transportation containers known as casks and which are docked with the mechanical passage. The passages in question can be made with a cutting tool and in accordance with the process described in French patent application 86 09915 of Jun. 4, 1986.

The cell also has an inner wall, known as the skin, which is made from stainless steel sheeting. Its function is to confine the contaminated atmosphere of the cell and also prevent the entry of external air. The problem which then arises is the obtaining of a very high level seal between the equipment installed in the wall and the cell wall and in particular its skin.

At present, use is made of a solution making it possible to bring about a seal to the mechanical crossing through the cell wall with the skin, but this solution is not very reliable. It also involves welding the sleeve of the mechanical crossing to the skin of the cell. It is pointed out that it is possible to produce a bead within the cell between the skin and the sleeve, but it is difficult to monitor the bead, because it is located on the contaminated side of the cell. This bead is produced by a rotary machine introduced into the sleeve. The performance of the process is difficult and repetition is required to terminate the welding operation. This solution cannot be used for mechanical crossings, whose diameters are smaller than the capacity of the machine to be welded.

Therefore the object of the invention is to obviate this disadvantage by proposing another process for installing a tight crossing in the wall of a cell in which are carried out operations with a high degree of contamination.

SUMMARY OF THE INVENTION

To this end, the main object of the invention is a process for the installation of a tight crossing in the wall of a high activity cell comprising a thick wall, a metal skin placed in the interior of the cell against the wall, a passage through the wall and the skin and a sealing bell introduced beforehand into the cell with the aid of a remote manipulator and placed, following the trepanning of the skin of the cell against the skin within the cell around the passage.

The process comprises the following successive stages:

a) putting into place of a sleeve in the passage, b) regulating the perpendicularity between the outside of the wall and the sleeve, c) fitting and fixing the base plate to the outside of the cell wall, d) welding the sleeve to the base plate, e) fitting within the sleeve a guide tube equipped with a tight double door placed in the interior of the cell, f) release of the bell, g) fitting a joint holder ring introduced beforehand into the cell in order to insulate said cell from the outside at the guide tube and the sleeve.

The invention is advantageously completed by two supplementary stages:

h) tightening captive nuts of the joint holder ring and i) fixing the assembly to the cell wall.

Preferably, during operations f) of releasing the bell and g) of fitting the joint holder ring, there is a ventilation from the outside to the inside of the cell in the crossing in order to overcome any contaminated air leaks from the inside to the outside of the cell.

Another object of the invention relates to a tight crossing through the wall of a high activity cell comprising a tubular sleeve, a guide tube placed within the sleeve, a tight double door placed at a first end of the sleeve and the guide tube, a support flange placed at a second end of the sleeve and the guide tube between the said two latter components and a joint holder flange placed at the first end of the sleeve and the guide tube, so as to be able to bear against the inner wall of a skin covering the interior of the cell, by compressing at least one second joint against the first end of the sleeve and the outer wall of the guide tube.

Preferably, it comprises a first joint placed in a groove of the outer surface of the guide tube and bearing against the inner surface of the sleeve.

It can be completed by a joint placed in a groove within the joint holder flange and bearing against the outer surface of the guide tube.

LIST OF DRAWINGS

The invention is described in greater detail hereinafter relative to non-limitative embodiments and the attached drawings, wherein show:

FIG. 1, in section, the installation of a crossing according to the invention in the wall of a cell.

FIG. 2, in section and detail, the tight crossing according to the invention.

DETAILED DESCRIPTION OF AN EMBODIMENT OF THE INVENTION

Figure 1:
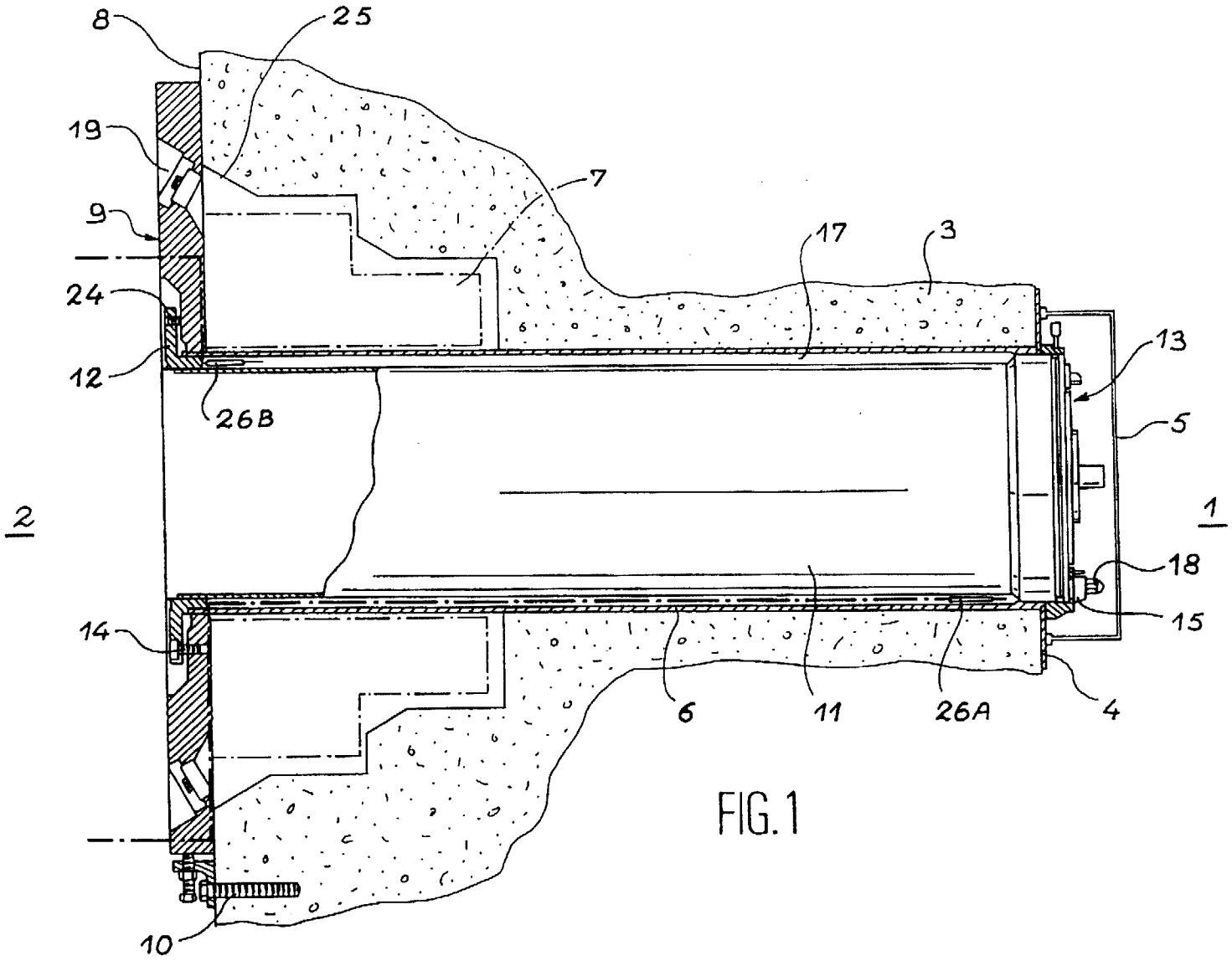

FIG. 1 shows in cross-section the wall of a cell, whose interior is designated 1 and exterior 2. The tight crossing according to the invention is consequently positioned in such a way as to traverse the said wall 3. A skin 4 covers the inner surface of the wall 3 from the interior 1 of the cell.

Said skin 4 is a stainless steel sheet covering the inner wall of the cell with a view to providing a highly efficient seal. A sealing bell 5 is fixed to the skin 4 facing the passage. This sealing bell 5 is fitted beforehand, at the time of making a passage through the wall 3 and the cell skin 4 within said cell. It is fixed to the skin 4 facing a passage.

Thus, the making if a hole permitting the passage through the wall 3 is carried out beforehand before putting into place the tight crossing. The making of the hole in the cell obviates a problem with which the operator is confronted for removing from the latter contaminated waste or small tools and which was neither programmed nor intended.

The first main operation of the process according to the invention is the putting into place of a tubular sleeve 6 in the passage. The said passage has an internal diameter equal to the external diameter of the sleeve 6. The hole in which is placed said sleeve 6 is widened from the exterior 2 of the cell in order to place there around said sleeve 6 a biological protection 7 necessary for nuclear installations and constituted by lead balls.

From the side of the interior 1 of the cell, the sleeve 6 bears on the surface of the skin 4 facing the wall 3. From the exterior 2 of the cell, the sleeve 6 is welded to a base plate 9 placed against the outer face 8 of the wall 3. This base plate 9 also contains the biological protection 7 and is provided with two access orifices 19 for the lead balls.

Thus, the sleeve 6 provides a cylindrical passage through the cell wall 3. It is preferable to perfectly regulate the perpendicularity of said sleeve 6 with respect to the base plate 9 placed against the wall 3.

The fitting of the base plate 9 takes place following the complete positioning and perpendicularity regulation of the sleeve 6 in the wall 3. For fixing the base plate use can be made of pegs or pins 10 penetrating the outer surface 8 of the cell wall 3.

A fourth essential stage of the process according to the invention consists of fitting in the sleeve 6 a guide tube 11, whose external diameter is slightly smaller than the internal diameter of the sleeve 6. For positioning it from the outside 2 of the cell, use is made of an annular flange 12 placed inside the sleeve 6, but outside the guide tube 11. Thus, it ensures the concentricity between the two tubular components constituted by the sleeve 6 and the guide tube 11. It is then welded to the latter and is also fixed to the base plate 9, e.g. by screws 14.

From the cell interior 1, the guide tube 11 carries a tight double door 13, whose subsequent function is to permit the passage of equipment from the cell interior 1 to the interior of the guide tube 11. This double door 13 is introduced at the same time as the guide tube 11, because it is fitted on the latter beforehand.

Figure 2:
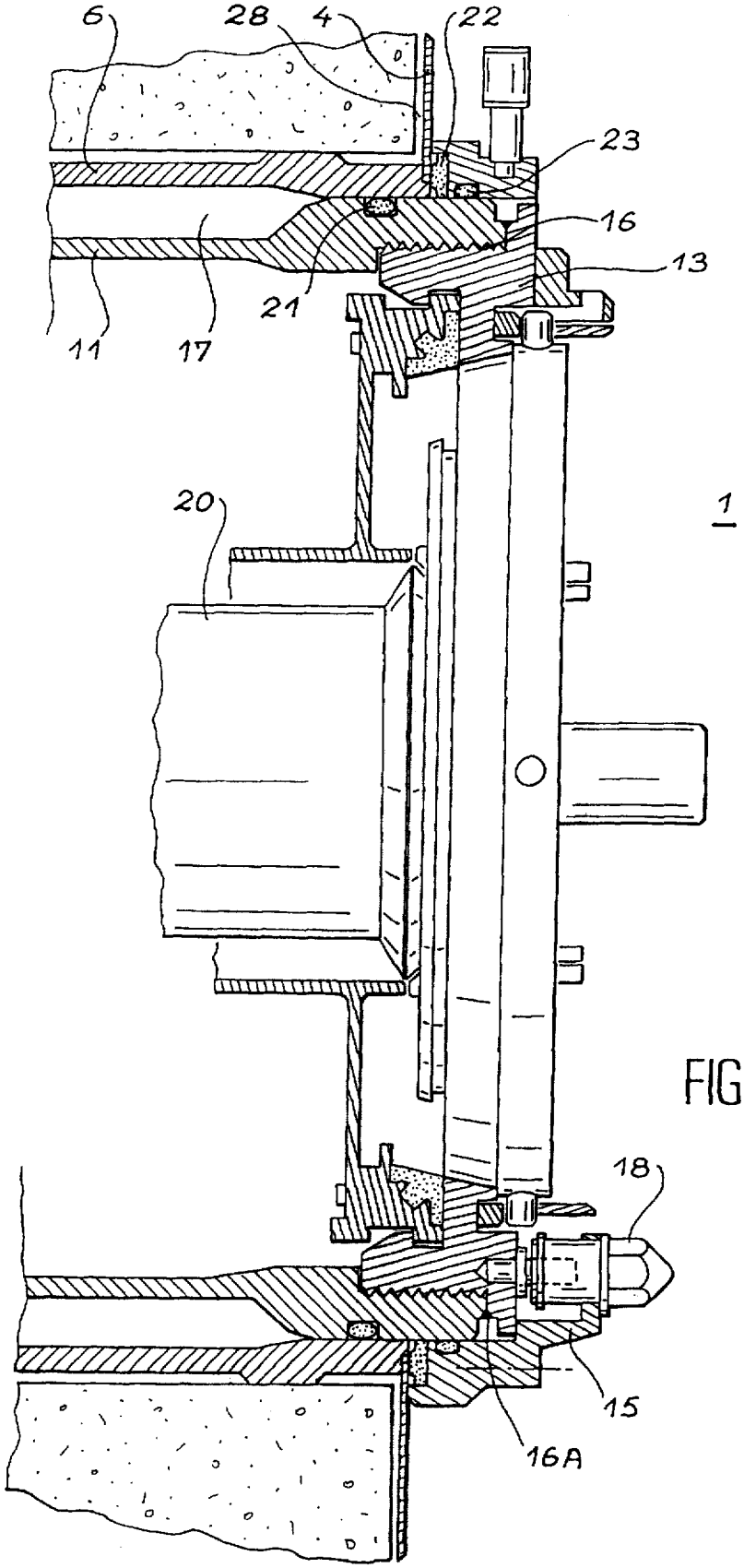

FIG. 2 shows the fitting of the double door 13 on the guide tube 11 by means of a thread 16 and a sealing weld 16A. The double door carries a central tube 20 for ensuring the transfer of small containers or equipments.

The process continues by the removal of the sealing bell 5, which remains in the interior 1 of the cell. It is dismantled by a remote manipulator in the cell interior 1.

The following stage consists of fitting a joint holder ring 15 from the cell interior 1 by remote manipulation on the external diameter of the inner end of the guide tube 11 located within the cell. The function of the joint holder ring 15 is to ensure the necessary sealing between the cell interior 1 and the annular space 17 remaining between the sleeve 6 and the guide tube 11.

FIG. 2 shows in detail the fitting of such a joint holder ring 15. The joint holder ring 15 is fixed by means of several captive nuts 18 actuated by a remote manipulator from the cell interior 1.

On the outside diameter of the guide tube 11 a first joint 21 is placed in a groove thereof. This first joint 21 ensures the necessary seal between the guide tube 11 and the sleeve 6.

A second joint 22 is placed just outside the skin 4 facing the joint holder ring 15. It provides a seal between the skin 4 and the guide tube 11, i.e. between the cell interior 1 and the space 28 between the skin 4 and the inner face of the wall 3 existing between the guide tube 11 and the sleeve 6. This second joint 22 is completed by a third joint 23 placed in a groove on the inside diameter of the joint holder ring 15 and bearing on the outside diameter of the guide tube 11.

The locking of the captive nuts 18 ensures the sealing of the ring 15 with the guide tube 11, whilst the tensioning carried out in order to engage the metal ring 15 on the cell skin makes it possible to obtain, when metallic contact is obtained, the compression of the joint 22 with a force ensuring the necessary sealing.

The tight crossing according to the invention is kept in place by support screws 24 and tightening screws 14. Use is made for this purpose of a not shown, tensioning tool essentially constituted by a hydraulic jack bearing both on the base plate 9 and on the support flange 12. Thus, by pulling the latter towards the exterior 2 of the cell, the support screws 24 can be secured in the support flange 12 in order to bear against the base plate 9, so as to keep in place the complete tight crossing and compress to the maximum the second joint 22. Once an adequate clamping has been exerted, the tightening screws 14 are tightened in the base plate 9 and the tight crossing is then fixed. The tensioning tool can then be dismantled.

It is at this time that it is possible to fill the space 25 within the wall 3 and outside the sleeve 6, using the biological protection 7 constituted by lead balls.

It is pointed out that during the phase consisting of removing the sealing bell 5 and putting into place the joint holder ring 15, the leakage risks from the interior 1 to the exterior 2 of the cell are greater. Therefore, it is proposed that an intervention lock be put into place in front of the cell in order to minimize possible contamination risks.

It is pointed out that the second joint 22 can be bonded and that its material can be 7EP42 (nuclear). The maximum compressive stress for this type of joint is 1500 daN.

The efficiency of the assembly can be proved by testing. Thus, in order to ensure the good seal of the fitted assembly (guide tube, container, joint holder ring), two tubes 26A and 26B are placed inside the annular space between the sleeve 6 and the guide tube 11 and are connected to the outside. Tube 26B is directly behind the flange 12. The test consists of filling, by means of the tube 26B, the space enclosed by the guide tube and the joint holder ring 15 with a neutral gas (nitrogen, argon, etc.) at a certain pressure and check by means of a pressure gauge fitted at the end of the lateral outlet of the tube 26A whether the pressure drops at the end of a previously defined time.

I claim:

1. Process for installing a tight crossing in the wall (3) of a tight cell, the latter comprising a thick wall (3), a metal skin (4) placed in the interior (1) of the cell against the wall (3), a passage through the wall (3) and the skin (4) and a sealing bell (5) placed against the skin within the interior (1) of the cell, around the passage, the process comprising the following successive stages:

a) placing a sleeve (6) in the passage, b) regulating the perpendicularity between the outside of the wall (3) and the sleeve (6), c) fitting a base plate (9) against the outer wall (8) of the cell wall (3), d) welding the sleeve (6) to the base plate (9), e) fitting within the sleeve (6) a guide tube (11) equipped with a tight double door (13) positioned facing the cell interior, under the sealing bell (5), f) release of the sealing bell (5), g) fitting a joint holder ring (15) through the interior of the cell to insulate the cell from the exterior (2) at the guide tube (11) and sleeve (6).

2. Process according to claim 1, characterized in that it comprises the two following supplementary stages:

h) securing captive nuts (18) on the joint holder ring (15) and i) fixing the tight crossing to the cell.

3. Process according to claim 1, characterized in that it comprises a supplementary ventilation stage from the exterior (2) to the interior (1) of the cell during the fifth (f) and sixth g) operations corresponding respectively to the release of the sealing bell (5) and the fitting of the joint holder ring (15).

4. Tight crossing through the wall (13) of a high activity cell comprising a tubular sleeve (6), a guide tube (11) placed in the interior of the sleeve (6), a tight double door (13) placed at a first end of the sleeve (6) and the guide tube (11), a support flange (12) placed at a second end of the sleeve (6) and the guide tube (11) between the two latter components (6, 11) and a joint holder flange (15) placed at the first end of the sleeve (6) and the guide tube (11), so as to be able to bear against the inner wall of a skin (4) covering the interior of the cell, by compressing at least one second joint (22) against the first end of the sleeve (6) and the outer wall of the guide tube (11).

5. Tight crossing according to claim 4, characterized in that it comprises a first joint (21) placed in a groove of the outer surface of the guide tube (11) and bearing against the inner surface of the sleeve (6).

6. Tight crossing according to claim 4 or 5, characterized in that it comprises a third joint (23) placed in a groove within the joint holder flange (15) and bearing against the outer surface of the guide tube (11).

7. Tight crossing according to claim 4, characterized in that it comprises two tubes (26A, 26B) placed between the sleeve (6) and the guide tube (11) and connected to the exterior in order to test the sealing of the crossing.

* * * * *

UNITED STATES PATENT AND TRADEMARK OFFICE

CERTIFICATE OF CORRECTION

PATENT NO. : 5,725,331

DATED : March 10, 1998

INVENTOR(S) : Jacques Martinez

It is certified that error appears in the above-indentified patent and that said Letters Patent is hereby corrected as shown below:

Column 4, line 51 (Claim 1, line 5), after "skin" insert --(4)--.

Signed and Sealed this

Twenty-eighth Day of July, 1998

Bruce Lehman

*Attest:*

BRUCE LEHMAN

*Attesting Officer*

*Commissioner of Patents and Trademarks*